US012448768B2

(12) United States Patent
Ritger et al.

(10) Patent No.: US 12,448,768 B2
(45) Date of Patent: Oct. 21, 2025

(54) MULTI-CHANNEL DRAIN COVER

(71) Applicant: InPro Corporation, Muskego, WI (US)

(72) Inventors: Joshua A. Ritger, Waukesha, WI (US); David R. Gebhardt, Milwaukee, WI (US)

(73) Assignee: InPro Corporation, Muskego, WI (US)

( * ) Notice: Subject to any disclaimer, the term of this patent is extended or adjusted under 35 U.S.C. 154(b) by 119 days.

(21) Appl. No.: 18/523,086

(22) Filed: Nov. 29, 2023

(65) Prior Publication Data

US 2025/0171995 A1 May 29, 2025

(51) Int. Cl.
*E03F 5/04* (2006.01)
*E03C 1/26* (2006.01)

(52) U.S. Cl.
CPC ..... *E03F 5/0407* (2013.01); *E03C 1/26* (2013.01)

(58) Field of Classification Search
CPC ..... E03C 1/26; E03F 5/0407
See application file for complete search history.

(56) References Cited

U.S. PATENT DOCUMENTS

| | | | | |
|---|---|---|---|---|
| 108,538 | A | 10/1870 | Walsh | |
| 2,119,923 | A | 6/1938 | Mcintyre | |
| 2,783,852 | A | 3/1957 | Sisk | |
| 4,257,892 | A | 3/1981 | Boersma | |
| RE31,561 | E | 4/1984 | Thompson | |
| 4,594,739 | A * | 6/1986 | Watts | E03C 1/26 137/844 |
| 5,759,414 | A | 6/1998 | Wilkes et al. | |
| 6,088,842 | A | 7/2000 | Barnett | |
| 8,505,125 | B1 | 8/2013 | Chia et al. | |
| 10,184,239 | B2 | 1/2019 | Meincke et al. | |
| 11,155,985 | B2 * | 10/2021 | Ritger | E03C 1/22 |
| 12,227,932 | B2 * | 2/2025 | Ciepluch | E03F 5/041 |
| 2006/0219619 | A1 | 10/2006 | St-Cyr | |
| 2007/0034577 | A1 | 2/2007 | Bayard et al. | |
| 2008/0271232 | A1 | 11/2008 | Self | |
| 2009/0007343 | A1 | 1/2009 | Houck | |
| 2010/0235982 | A1 | 9/2010 | Stimpson et al. | |
| 2011/0154563 | A1 | 6/2011 | Ball et al. | |
| 2012/0036631 | A1 | 2/2012 | Cook | |
| 2012/0047643 | A1 | 3/2012 | Meyers | |
| 2014/0166560 | A1 | 6/2014 | Cohen et al. | |

(Continued)

OTHER PUBLICATIONS

The Intersan Group, "CRR Drains, 303070XN/303077XN, Crocodile Roll Resistant Drain," Specification, 2 pages.

(Continued)

*Primary Examiner* — Janie M Loeppke
(74) *Attorney, Agent, or Firm* — Reinhart Boerner Van Deuren s.c.

(57) ABSTRACT

A drain assembly for providing a drain passage for fluid flow from a surface to the drainpipe of a plumbing system. The surface would typically be that of a structure such as that of a floor, a floor of a shower or floor of a bathtub. The drain assembly includes a multi-channel cover wherein each flow channel is configured or curved in such a way to prevent the passage of a ligation (e.g., wire, cord, or rope) through the channels to allow the ligation to be tied to the cover. The multi-channel cover is formed from a plate coupled to one or more annular diverter walls that form a portion of the curved flow channel shape.

20 Claims, 15 Drawing Sheets

(56) References Cited

U.S. PATENT DOCUMENTS

| | | | |
|---|---|---|---|
| 2018/0100298 | A1 | 4/2018 | Willburn |
| 2020/0291631 | A1 | 9/2020 | Boeltl |

OTHER PUBLICATIONS

Oatey, "Installation Instructions for Ligature Resistant Drain Cover In Oatey #42150 Shower Drain," 2 pages.
Whitehall Manufacturing, "Ligature Resistant Floor Drain Grate," August 4, 20218, 1 page.
Whitehall Manufacturing, "Ligature Resistant No. Caulk Shower Drain," Aug. 13, 2019, 1 page.
Tower Surfaces, "Ligature Resistant Shower Drain Cover," 2 pages.
Oatey, "140 Series / 101 PNC Series Brass and Plastic No-Calk Shower Drain," Oct. 2005, 1 page.

* cited by examiner

MULTI-CHANNEL DRAIN COVER

BACKGROUND OF THE INVENTION

The present invention relates to ligation resistant drains, including drain covers and associated drain assemblies for use as floor drains, sink drains, shower drains, bathtub drains, etc and manufacturing methods therefor. In particular, the cover and assembly resist the ability to tie a ligation such as a wire, rope, string, shoelace, etc. through the fluid flow openings in the drain cover. Additionally, the drain includes separated fluid flow pathways that aid in the venting of the drain to facilitate fluid flow through the drain and cover assembly.

SUMMARY OF THE INVENTION

One embodiment of the present invention provides for a multi-channel, ligation resistant drain cover having a top side and a bottom side. The cover includes a top plate having a top surface, a bottom surface, a periphery, a first interior fluid flow opening extending between the top and bottom surface, and a first exterior fluid flow opening extending between the top and bottom surface and located between the interior fluid flow opening and the periphery. The cover includes an exterior fluid guide wall extending from the bottom surface between the periphery and the exterior fluid flow opening. The exterior fluid guide wall includes a first diverter wall displaced from the bottom surface and that extends at a first angle from the exterior fluid guide wall. The cover includes an intermediate fluid guide wall extending from the bottom surface between the interior and exterior flow openings. The intermediate fluid guide wall includes a second diverter wall displaced from the bottom surface that extends at a second angle from the intermediate fluid guide wall. The exterior and intermediate fluid guide walls are located to form a curved exterior fluid flow channel extending from the top surface, through the exterior fluid flow opening and exiting at the bottom side of the cover at an exterior exit. The cover includes an interior fluid guide wall extending from the bottom surface and cooperating with the intermediate fluid guide wall to form a curved interior fluid flow channel separate from the exterior fluid flow channel and extending from the top surface, through the interior fluid flow opening and exiting at the bottom side of the cover at an interior exit separate from and displaced from the exterior exit. The cover includes a first bonding material and a second bonding material. The first diverter wall is a separate component from the top plate, such that the first diverter wall is coupled to the top plate by the first bonding material. The second diverter wall is a separate component from the top plate, the second diverter wall being coupled to the top plate by the second bonding material. The first diverter wall includes a protruding edge. The protruding edge extends into the curved exterior fluid flow channel and away from the bottom side of the cover such that a surface of the exterior fluid guide wall that forms the curved exterior fluid flow channel curves toward the top surface of the cover.

Another embodiment of the present invention provides for a multi-channel, ligation resistant drain assembly including an interface for creating a sealed fluid channel between a flow and a drainpipe. The interface including a flange for attachment to a floor surface, such that the flange is joined to a tubular portion for attachment to the drainpipe. The drain assembly also includes a drain cover. The drain cover includes a top plate formed from a first metal that is attachable to the flange and includes a top surface, a bottom surface, a periphery, a first interior fluid flow opening extending between the top and bottom surface, and a first exterior fluid flow opening extending between the top and bottom surface and located between the interior fluid flow opening and the periphery. The drain cover includes an exterior fluid guide wall extending from the bottom surface between the periphery and the exterior fluid flow opening. The exterior fluid guide wall includes a first diverter wall formed from a second metal and displaced from the bottom surface and extending at a first angle from the exterior fluid guide wall. The drain cover includes an intermediate fluid guide wall extending from the bottom surface between the interior and exterior flow openings. The intermediate fluid guide wall includes a second diverter wall formed from a third metal and displaced from the bottom surface and extending at a second angle from the intermediate fluid guide wall. The exterior and intermediate fluid guide walls are located to form a curved exterior fluid flow channel extending from the top surface, through the exterior fluid flow opening and exiting at the periphery of the cover at an exterior exit. The drain cover includes an interior fluid guide wall extending from the bottom surface and cooperating with the intermediate fluid guide wall to form a curved interior fluid flow channel separate from the exterior fluid flow channel and extending from the top surface, through the interior fluid flow opening and exiting at the periphery of the cover at an interior exit separate from and displaced from the exterior exit. The drain cover includes a first bonding material and a second bonding material. The first diverter wall is a separate component from the top plate that is coupled to the first bonding material, the first diverter wall being coupled to the top plate by a first welded joint the first welded joint. The first welded joint includes the first metal and the second metal. The second diverter wall is a separate component from the top plate that is coupled to the second bonding material, the second diverter wall being coupled to the top plate by a second welded joint. The second welded joint includes the first metal and the third metal.

Still another embodiment of the present invention provides for a method for manufacturing a multi-channel, ligation resistant drain cover having a top side and a bottom side. The method includes forming a drain cover body, the drain cover body including a top plate, an exterior fluid guide wall, an intermediate fluid guide wall, and an interior guide wall. The method includes forming an exterior annular portion including a first diverter wall such that the exterior annular portion is a separate component from the drain cover body. The method includes forming an interior annular portion including a second diverter wall such that the interior annular portion is a separate component from the drain cover body. The method includes coupling the exterior annular portion to the drain cover body by a first bonding material. The method further includes coupling the interior annular portion to the drain cover body by a second bonding material. The drain cover manufactured by this method includes the top plate including a top surface, a bottom surface, a periphery, a first interior fluid flow opening extending between the top and bottom surface, and a first exterior fluid flow opening extending between the top and bottom surface and located between the interior fluid flow opening and the periphery. The drain cover includes the exterior annular portion including the first diverter wall and the exterior fluid guide wall extending from the bottom surface between the periphery and the exterior fluid flow opening. The first diverter wall of the exterior annular portion is displaced from the bottom surface and extends at a first angle from the exterior fluid guide wall. The drain cover includes the interior annular portion including the second diverter wall and the intermediate fluid guide wall extending from the bottom surface between the interior and exterior flow openings. The second diverter wall of the interior annular portion is displaced from the bottom surface and extends at a second angle from the intermediate fluid guide wall. The exterior and intermediate fluid guide walls are located to form a curved exterior fluid flow channel extending from the top surface, through the exterior fluid flow opening and exiting at the bottom side of the cover at an exterior exit. The drain cover further includes an interior fluid guide wall extending from the bottom surface and cooperating with the intermediate fluid guide wall to form a curved interior fluid flow channel separate from the exterior fluid flow channel and extending from the top surface, through the interior fluid flow opening and exiting at the bottom side of the cover at an interior exit separate from and displaced from the exterior exit. The drain cover includes the first bonding material and the second bonding material.

Additional features and advantages will be set forth in the detailed description which follows, and, in part, will be readily apparent to those skilled in the art from the description or recognized by practicing the embodiments as described in the written description and claims thereof, as well as the appended drawings. It is to be understood that both the foregoing general description and the following detailed description are exemplary.

The accompanying drawings are included to provide further understanding and are incorporated in and constitute part of the specification. The drawings illustrate one or more embodiments, and together with the description serve to explain the principles and operation of various embodiments.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, various embodiments of a multi-channel, ligation resistant drain cover are shown. Embodiments of the multi-channel drain cover include an innovative design to provide for a variety of desired characteristics, including resisting the ability to tie a ligation such as a wire, rope, string, shoelace, etc. through the fluid flow openings in the drain cover. In some conventional multi-channel drain covers, the drain cover having fluid pathways is formed from a single contiguous, continuous component. Applicant has found it beneficial to provide a multi-channel drain cover that is formed from a drain cover body coupled to separate components forming angled diverter walls within fluid pathways of the drain cover. This allows for simpler geometry of the components of the drain cover, resulting in easier and more cost-effective manufacturing, such as, for example, when the components of the drain cover are formed by casting metals like steel.

Figure 1:
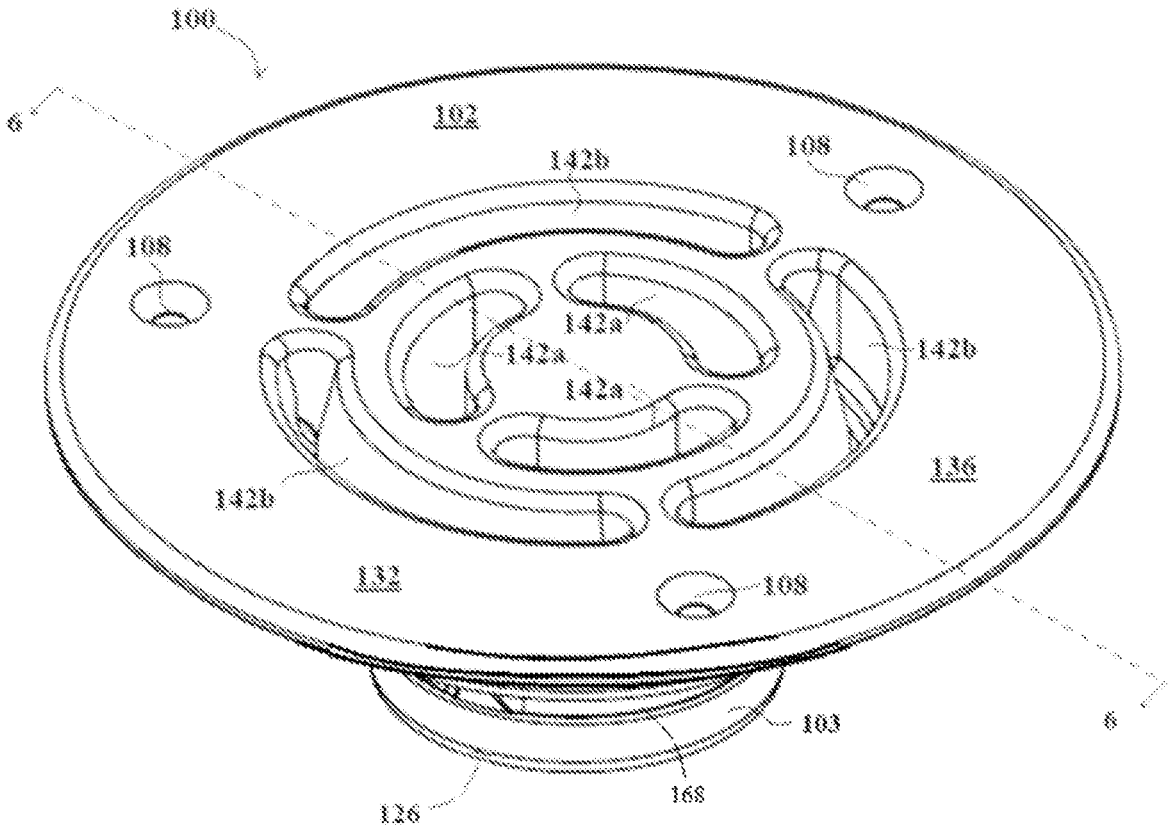
FIG. 1 is a top perspective view of a drain cover, according to an exemplary embodiment.
Figure 2:
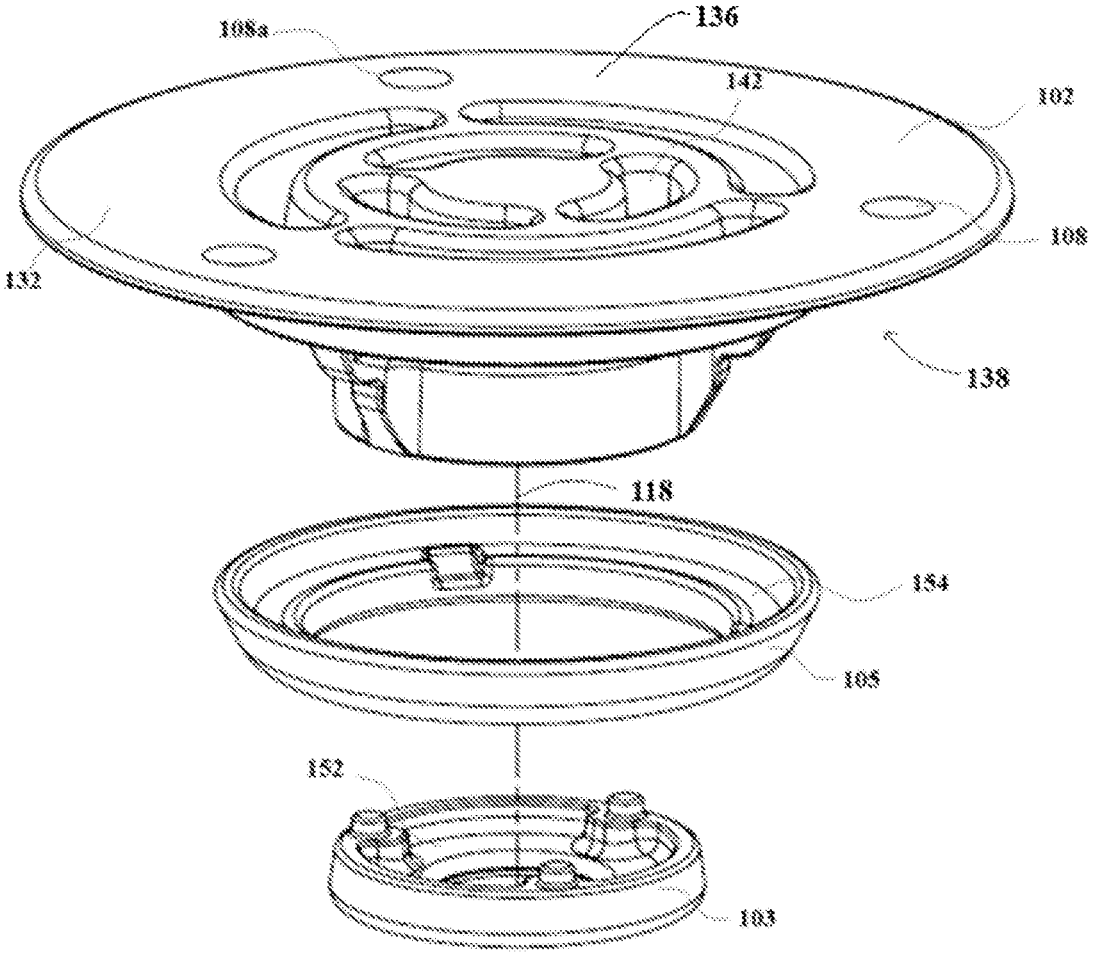
FIG. 2 is an exploded perspective view of the drain cover of FIG. 1, according to an exemplary embodiment.

Referring to FIGS. 1-14, a multi-channel ligation resistant drain cover 102 is shown, according to an exemplary embodiment. As shown in FIG. 1, ligation resistant drain cover 102 has an upper side or top surface 132. Cover 102 forms a disk or plate 136 that defines top surface 132, e.g., on a top side of plate 136. Cover 102 has a radially extending side profile about central axis 118 that forms a periphery 138 (FIG. 2). In some embodiments, plate 136 is circular, and periphery 138 is defined radially about central axis 118.

Cover 102 includes an interior annular portion 103 and an exterior annular portion 105, shown in FIG. 2. Interior annular portion 103 and exterior annular portion 105 extend substantially radially inward toward central axis 118. Interior annular portion 103 and exterior annular portion 105 are discontinuous, separate, and/or independent components from plate 136.

Exterior annular portion 105 is bonded to plate 136 by a first welded joint 166. Interior annular portion 103 is bonded to plate 136 by a second welded joint 168. The first welded joint 166 is an area of a first bonding material formed from a mixture of the base metal of the exterior annular portion 105, the base metal of a portion of cover 102 extending from plate 136, and a filler material associated with welding. The filler material is that material which is the base material for welding rod or wire. The second welded joint 168 is an area of a second bonding material formed from a mixture of the base metal of interior annular portion 103, the base metal of a portion of cover 102 extending from plate 136, and a filler material similar to that used in the first welded joint 166. In an alternative embodiment, exterior annular portion 105 and interior annular portion 103 are frictionally welded to a portion of drain cover 102 extending from plate 136, such as by spin welding. With this welding process, the welded joints are formed from the material resulting from the melting and comingling of the adjacent materials. This type of welded joint does not include a filler material.

Alternatively, interior annular portion 103 and exterior annular portion 105 can be bonded to plate 136 using brazing. With this bonding method, brazed joints are formed between interior annular portion 103 and plate 136, and exterior annular portion 105 and plate 136. These joints include a brazing material such as tin or brass or any material compatible with brazing the associated portions to the plate.

In another embodiment, exterior annular portion 105 is bonded to plate 136 by a first bonding joint, and interior annular portion 103 is bonded to plate 136 by a second bonding joint. First bonding joint includes a first adhesive bonding material, and second bonding joint includes a second adhesive bonding material. First adhesive bonding material is in contact with a portion of drain cover 102 extending from plate 136 and exterior annular portion 105, and second adhesive bonding material is in contact with a portion of drain cover 102 extending from plate 136 and interior annular portion 103. In various embodiments, the first adhesive bonding material and the second adhesive bonding material include glue, epoxy, cement, and/or plastic bonding agents. First bonding joint and second bonding joint are formed through evaporation of a solvent, heat curing, light curing, time curing, and/or pressure curing.

Drain cover 102 can be manufactured by first forming each of plate 136, interior annular portion 103 and exterior annular portion 105 as separate components, such as, for example, by casting each component in steel. In a specific embodiment, plate 136 and any contiguous, continuous portions extending from plate 136 are formed from a first metal, such as steel. Exterior annular portion 105 is formed from a second metal, such as steel, and interior annular portion 103 is made from a third metal, such as steel. Exterior annular portion 105 is coupled to plate 136 by the first bonding material. Interior annular portion 103 is coupled to plate 136 by the second bonding material. In a specific embodiment, drain cover 102 is manufactured by bonding interior annular portion 103 and exterior annular portion 105 to plate 136 via welding such that the first welded joint 166 formed from a mixture including the first metal and the second metal is formed between exterior annular portion 105 and plate 136, and the second welded joint 168 formed from a mixture including the first metal and the third metal is formed between interior annular portion 103 and plate 136.

Figure 3:
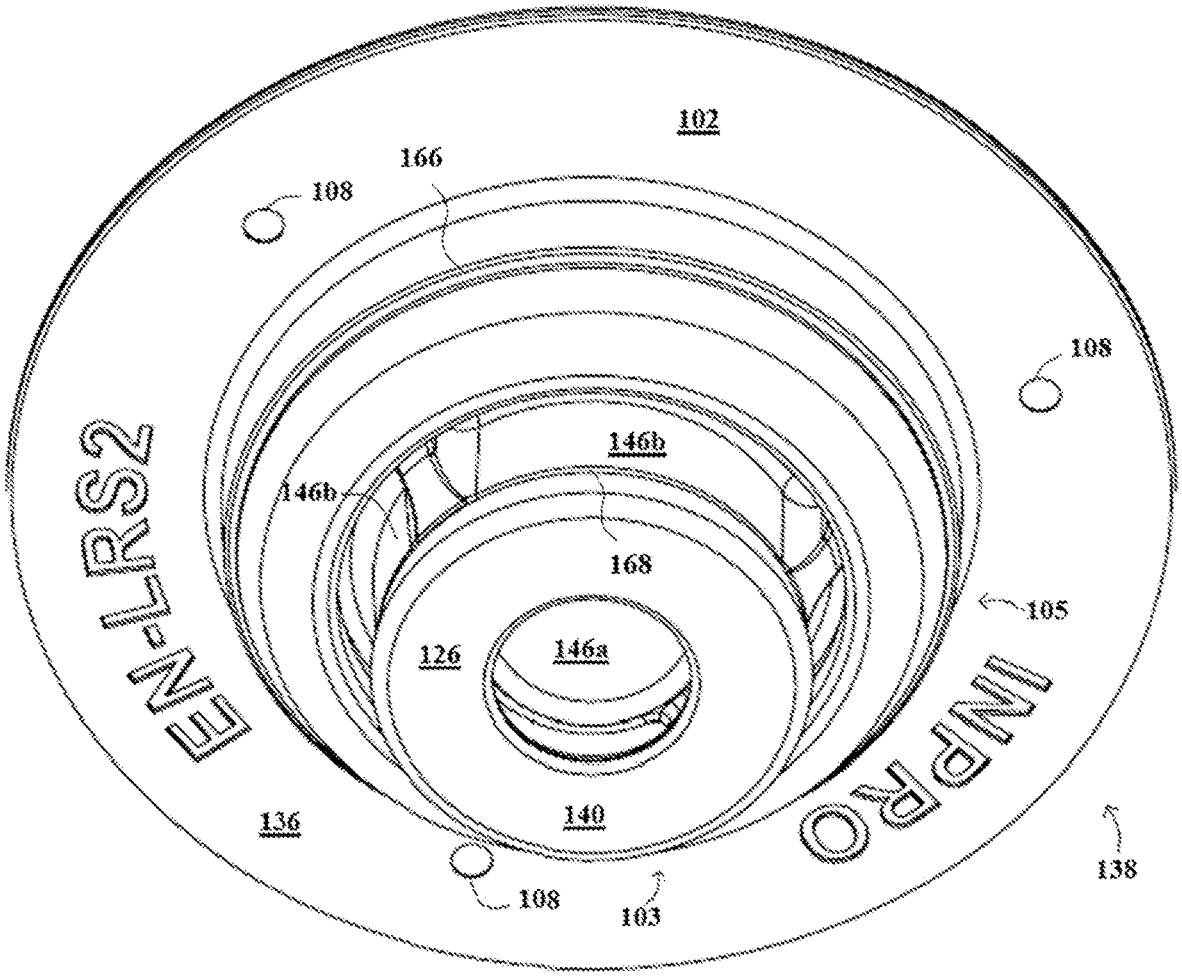
FIG. 3 is a bottom perspective view of the drain cover of FIG. 1, according to an exemplary embodiment.
Figure 4:
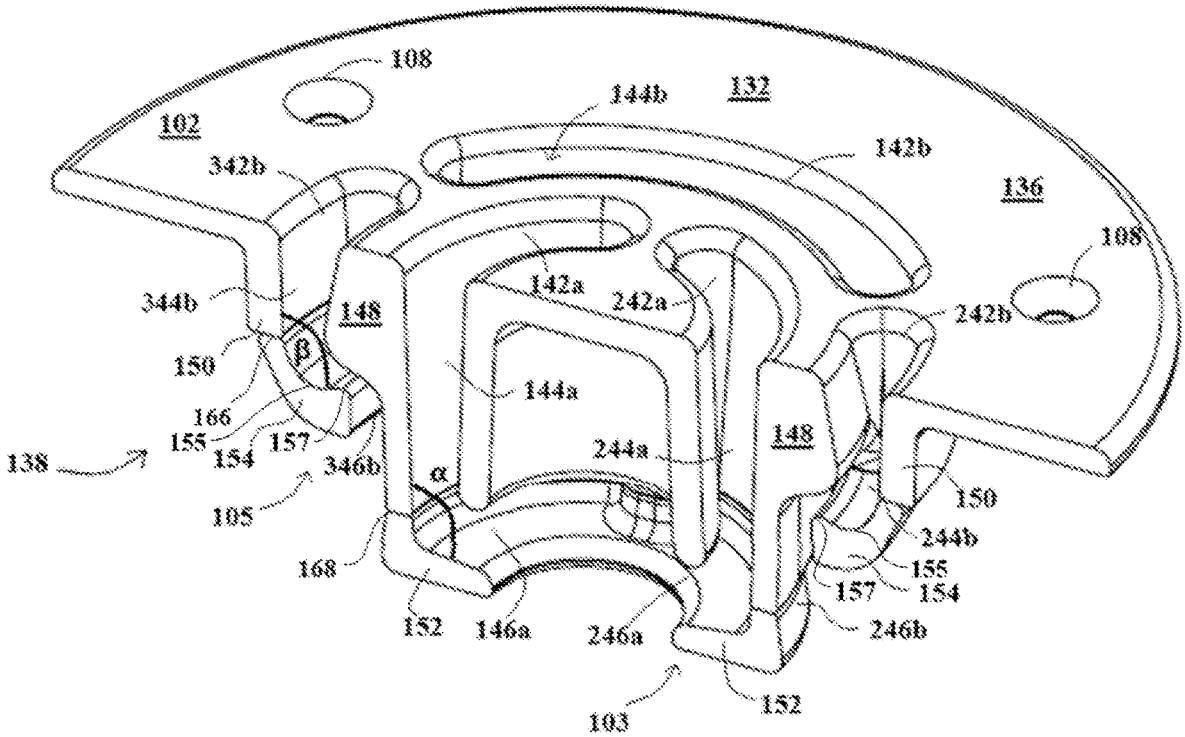
FIG. 4 is a perspective sectional view of the drain cover of FIG. 1 taken along line 6-6 of FIG. 1, according to an exemplary embodiment.

Referring to FIG. 3, cover 102 includes a bottom 126. Bottom 126 defines a bottom surface 140. As shown in FIG. 4, fluid flow openings 142 on top surface 132 lead to channels 144 that extend through cover 102 to communicate fluid from top surface 132 to bottom surface 140, e.g., like a drain. In various embodiments, channels 144 are angled, curved, terminate at different locations, and/or are not in fluid communication with adjacent channels 144 to enhance the ligation resistance of cover 102.

For example, interior and exterior fluid flow openings $\mathbf{142}_a$ and $\mathbf{142}_b$ communicate through cover 102 between top surface 132 and bottom surface 140 via interior and exterior channels $\mathbf{144}_a$ and $\mathbf{144}_b$, respectively. Fluid, such as water, enters cover 102 in either interior or exterior fluid flow openings $\mathbf{142}_a$ or $\mathbf{142}_b$ on top surface 132, passes through the respective interior or exterior channel $\mathbf{144}_a$ or $\mathbf{144}_b$ and exits through an interior or exterior exit $\mathbf{146}_a$ or $\mathbf{146}_b$, respectively. In other words, fluids that enter opening 142 pass through a corresponding channel 144 of cover 102 to an exit 146 on or near bottom surface 140. In some embodiments, interior channel $\mathbf{144}_a$ vent drain cover 102 as exterior channel $\mathbf{144}_b$ receives the drained liquid.

Exterior flow opening $\mathbf{142}_b$ is located between interior fluid flow opening $\mathbf{142}_a$ and periphery 138 and forms a separate exterior fluid channel $\mathbf{144}_b$ that is not in communication with interior fluid channel $\mathbf{144}_a$. Applicant has found that this configuration enhances ligation resistance by preventing the coupling of opposite ends of a rope (e.g., a shoelace) and prevents modification or alteration of drain cover 102 by a user.

In some embodiments, interior opening $\mathbf{142}_a$ and exterior opening $\mathbf{142}_b$ are displaced and/or angled relative to one another. Similarly, interior and/or exterior channels $\mathbf{144}_a$ and/or $\mathbf{144}_b$ may be curved, angled, and/or terminate or end in different locations to enhance ligation resistance. For example, as shown in FIG. 4, an intermediate fluid guide wall 148 and an exterior fluid guide wall 150 define curvilinear boundaries for interior and exterior channels $\mathbf{144}_a$ and $\mathbf{144}_b$. As shown in FIG. 4, exterior exit $\mathbf{146}_b$ is elevated from interior exit $\mathbf{146}_a$. In a specific embodiment, a portion of the bottom of intermediate guide wall 148 is located on interior annular portion 103 such that a portion of intermediate guide wall 148 is a discontinuous, separate, and/or individual component from plate 136. Exterior annular portion 105 is in direct contact with and couples to exterior fluid guide wall 150 and extends radially inward from exterior fluid guide wall 150.

Intermediate fluid guide wall 148 extends from a bottom of plate 136 between interior and exterior flow openings $\mathbf{142}_a$ and $\mathbf{142}_b$ and terminates at an interior diverter wall 152. Interior diverter wall 152 is displaced from bottom surface 140 and extends at an angle $\alpha$ from intermediate fluid guide wall 148. In a specific embodiment, interior diverter wall 152 is located on interior annular portion 103 such that interior diverter wall 152 is a discontinuous, separate, and/or independent component from plate 136. Applicant has found that forming interior diverter wall 152 as a separate component from plate 136 that is then coupled to plate 136 simplifies the geometry of plate 136 and interior diverter wall 152, thereby reducing the costs to manufacture each component relative to the cost of manufacturing interior diverter wall 152 and plate 136 as a single contiguous, continuous component. Intermediate fluid guide wall 148 extends from plate 136 to form a curved interior fluid flow passage, or interior channel $\mathbf{144}_a$, which is separate from exterior fluid flow channel $\mathbf{144}_b$.

Similarly, exterior fluid guide wall 150 extends from a bottom surface of plate 136 between periphery 138 and exterior fluid flow opening $\mathbf{142}_b$. Exterior fluid guide wall 150 terminates at an exterior diverter wall 154 that is displaced or offset from bottom surface 140. Exterior diverter wall 154 extends at an angle $\beta$ from exterior fluid guide wall 150 to define an exit angle, e.g., of a fluid or an inserted rope exiting drain cover 102 at exterior exit $\mathbf{146}_b$. In a specific embodiment, exterior diverter wall 154 is located on exterior annular portion 105 such that exterior diverter wall 154 is a discontinuous, separate, and/or independent component from plate 136. Applicant has found that forming exterior diverter wall 154 as a separate component from plate 136 that is then coupled to plate 136 simplifies the geometry of plate 136 and exterior diverter wall 154, thereby reducing the costs to manufacture each component relative to the cost of manufacturing exterior diverter wall 154 and plate 136 as a single contiguous, continuous component.

Intermediate and exterior fluid guide walls 148 and 150 are located to form a curved exterior fluid flow channel, or exterior channel $\mathbf{144}_b$ that extends from top surface 132, through exterior fluid flow opening $\mathbf{142}_b$ and exits on the bottom surface 140 of cover 102 at interior and exterior exits $\mathbf{146}_a$ and $\mathbf{146}_b$, respectively. Intermediate and/or exterior guide walls 148 and/or 146 can be radially defined from central axis 118 to include respective cylindrical portions and/or cylindrical or circular interior and/or exterior diverter walls 152 and/or 154. In some embodiments, deflectors or diverters formed by diverter walls 152 and 150 are washer shaped.

In various embodiments, angle $\alpha$ is between 80° and 120°, specifically, between 90° and 110°, and more specifically 100°, such that interior diverter wall 152 is parallel with plate 136. Similarly, in various embodiments, angle $\beta$ is between 90° and 130°, specifically, between 100° and 120°, and more specifically 110°, such that exterior diverter wall 154 is parallel with plate 136. In these embodiments, for example, exterior diverter wall 154 is angled in such a way that a rope inserted into exterior channel $\mathbf{144}_b$ exits in a direction (e.g., angle $\beta$) that is different from a direction (e.g., angle $\alpha$) a rope inserted into interior channel $\mathbf{144}_a$ exits. In this way, interior and exterior diverter walls 152 and 154 enhance ligation resistance.

Interior channel $\mathbf{144}_a$ extends from top surface 132, through interior fluid flow opening $\mathbf{142}_a$ and exits on the bottom side of cover 102 at an interior exit $\mathbf{146}_a$. Interior exit $\mathbf{146}_a$ is separate from and displaced from exterior exit $\mathbf{146}_b$. Similarly, interior channel $\mathbf{144}_a$ is separate from and not in fluid communication with exterior channel $\mathbf{144}_b$ to enhance ligation resistance. In some embodiments, interior exit $\mathbf{146}_a$ is located further from the bottom surface 140 than exterior exit $\mathbf{146}_b$, for example, because interior channel $\mathbf{144}_a$ is longer than exterior channel $\mathbf{144}_b$. In some embodiments, interior diverter wall 152 is displaced from exterior diverter wall 154 such that an offset 156 (FIG. 7) exists between interior diverter wall 152 and exterior diverter wall 154. For example, interior exit $\mathbf{146}_a$ is located further from the bottom surface 140 than exterior exit $\mathbf{146}_b$. In various embodiments, offset 156 is less than 2 inches, specifically less than 1 inch, and more specifically less than 0.5 inches. In various embodiments, offset 156 is between 0.25 inches and 1 inch, specifically between 0.4 inches and 0.75 inches, and, more specifically, is 0.50±0.05 inches.

Figure 5:
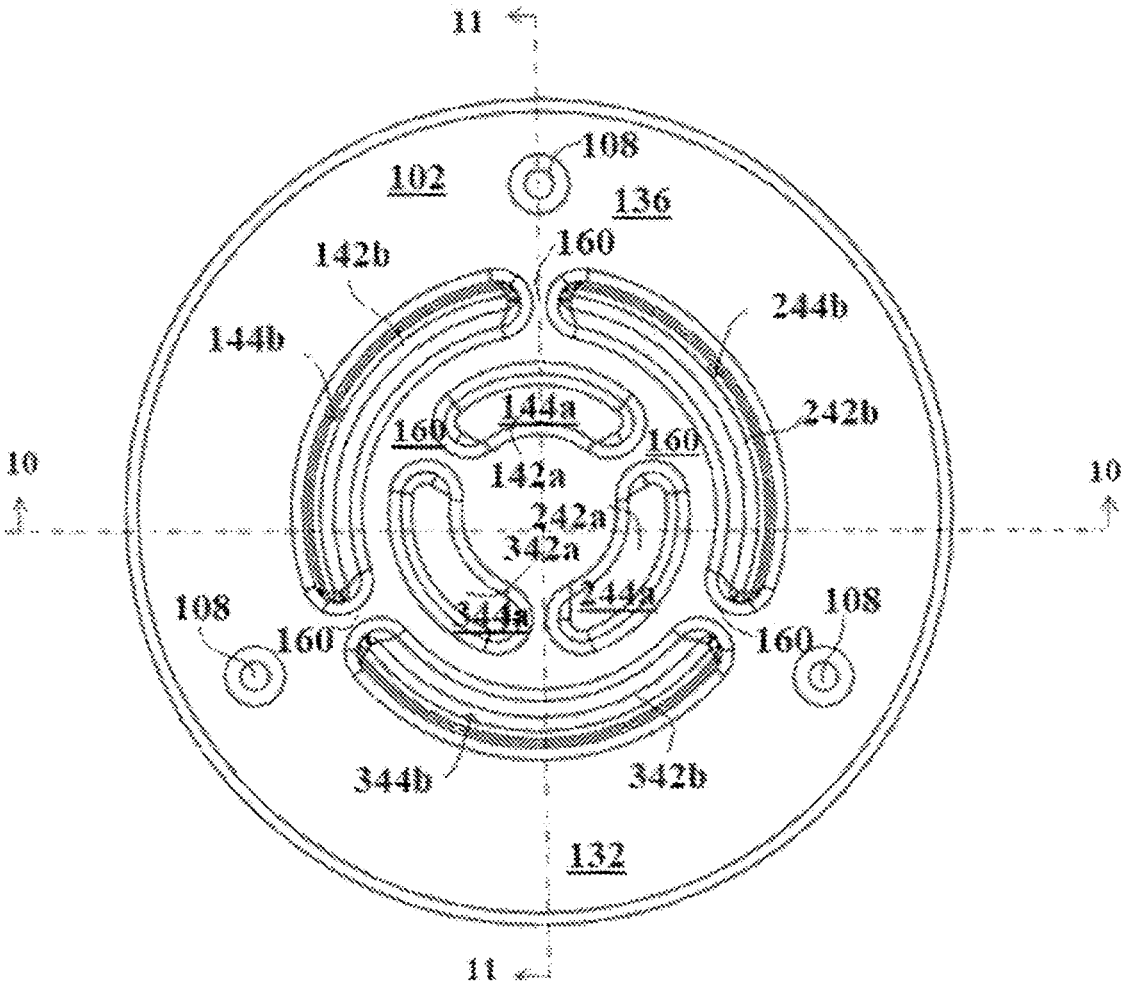
FIG. 5 is a top view of the drain cover of FIG. 1, according to an exemplary embodiment.
Figure 6:
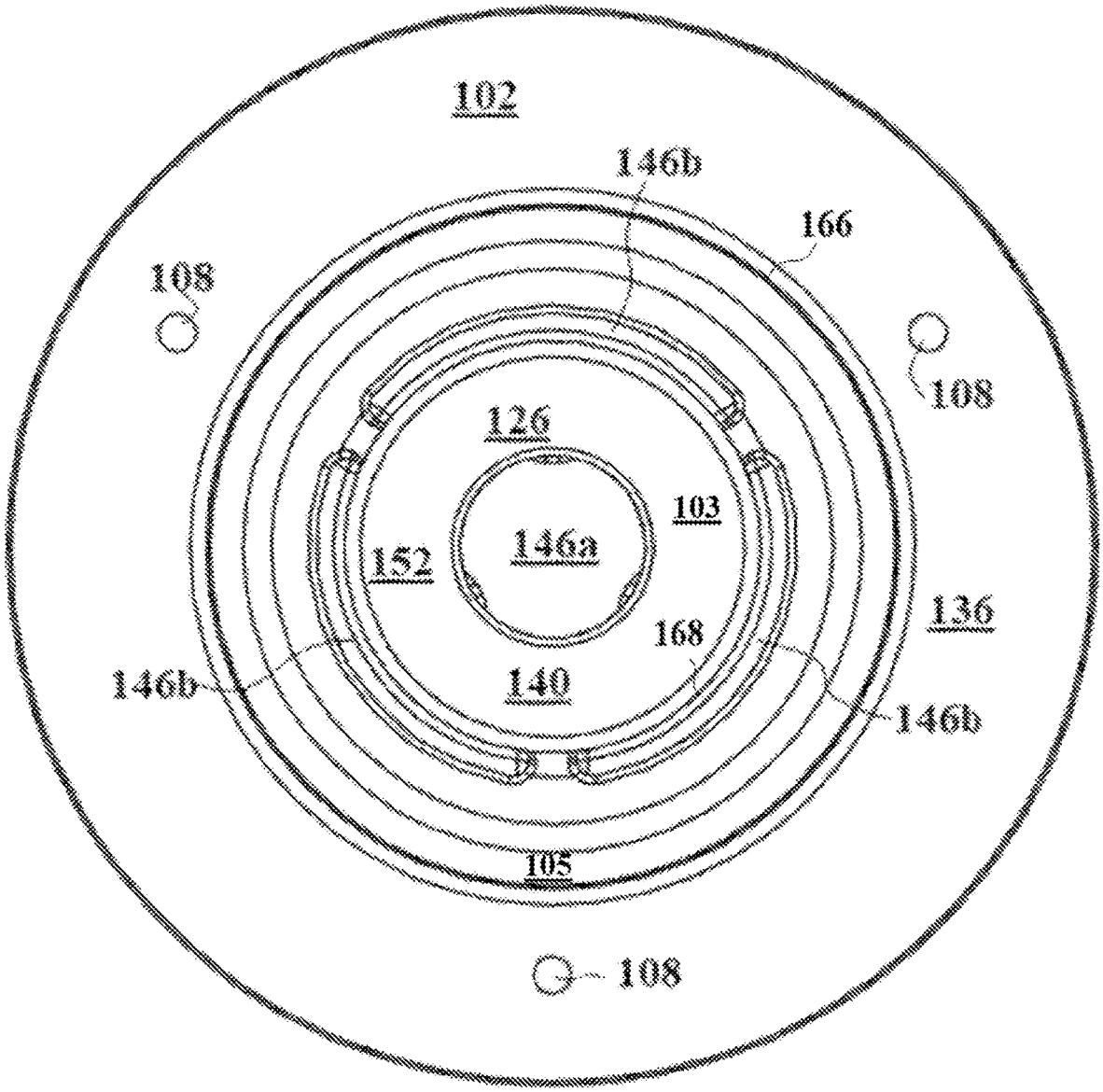
FIG. 6 is a bottom view of the drain cover of FIG. 1, according to an exemplary embodiment.
Figure 7:
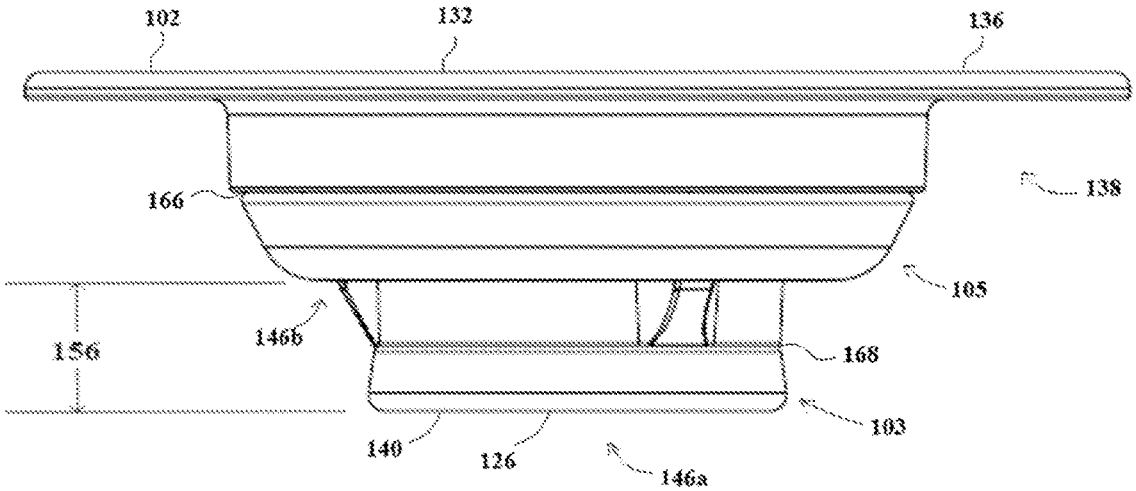
FIG. 7 is a side view of the drain cover of FIG. 1, according to an exemplary embodiment.

FIG. 5 shows another embodiment with additional channels 144 and/or walls 160. In general, reference is made to openings 142, channels 144, and exits 146, but additional independent openings 242 and/or 342, independent channels 244 and/or 344, and independent exits 246 and/or 346 may be used on drain cover 102 to generate additional independent flow paths 158 and thus increase ligation resistance. Flow paths 158 are voids or spaces in cover 102 that include openings 142, channels 144, and exits 146 and are independent and separate from other flow paths 158. For example, two channels 144 may be in fluid communication and thus only define one flow path 158. In other words, a single flow path 158 may have any combination of openings 142, channels 144, and exits 146 that are all in fluid communication with one another.

In various embodiments, two or three independent flow paths 158 can be defined through cover 102. In some embodiments, each flow opening 142 defines a unique flow path 158 through a unique channel 144 and exit 146. In other words, water that enters a first flow path 158 would enter through opening 142, pass through channel 144, and exit through exit 146. Similarly, second and or third flow paths 258 and 358 are envisioned. For example, a second flow path 258 may include a second interior flow opening 242*a* that is in fluid communication with a second channel $\mathbf{244}_a$ and a second exit $\mathbf{246}_a$. Similarly, a third flow path 358 may include a third flow opening $\mathbf{342}_a$ that communicates with third channel $\mathbf{344}_a$ and third exit $\mathbf{346}_a$. Since each flow path 158, 258, and 358 is independent and separate, additional interior dividing walls 160 (e.g., two or three) extend between intermediate fluid guide wall 148 and intermediate fluid guide wall 148 form separate interior flow paths 158, 258, and 358. In other words, dividing walls 160 separate interior fluid flow channels 144, 244, and 344. Each flow path 158, 258, and 358 is independent and associated with one of the interior flow openings $\mathbf{142}_a$, 242*a*, or $\mathbf{342}_a$, and one of the interior exits $\mathbf{146}_a$, $\mathbf{246}_a$, or $\mathbf{346}_a$.

Similar to the interior flow paths 158, exterior flow paths 158 may be independent and separate. For example, a first exterior opening $\mathbf{142}_b$ communicates with a first exterior channel $\mathbf{144}_b$ that exits at a first exterior exit $\mathbf{146}_b$. A second exterior flow opening $\mathbf{242}_b$ and/or third exterior flow opening $\mathbf{342}_b$ can be added with corresponding second and/or third exterior channels $\mathbf{244}_b$ and/or $\mathbf{344}_b$ and second and/or third exterior exits $\mathbf{246}_b$ and/or $\mathbf{346}_b$.

In a multiple flow path 158 configurations, channels 244 and/or 344 are the same as or similar to channel 144 except for the differences described. In contrast to channel 144, channels 244 and/or 344 have independent flow paths 158 that are not in fluid communication with any other channel 144, 244, or 344. Similar differences exist for openings 142, 242, and 342, as well as exits 146, 246, and 346. In this configuration, cover 102 has two exterior dividing walls 160 that extend between intermediate fluid guide wall 148 and exterior fluid guide wall 150 to form two separate exterior flow paths 158 through the exterior fluid flow channel $\mathbf{144}_b$, $\mathbf{244}_b$, and $\mathbf{344}_b$. Each flow path 158, 258, and 358 is independent and associated with one of the exterior flow openings $\mathbf{142}_b$, $\mathbf{242}_b$, and $\mathbf{342}_b$.

Figure 10:
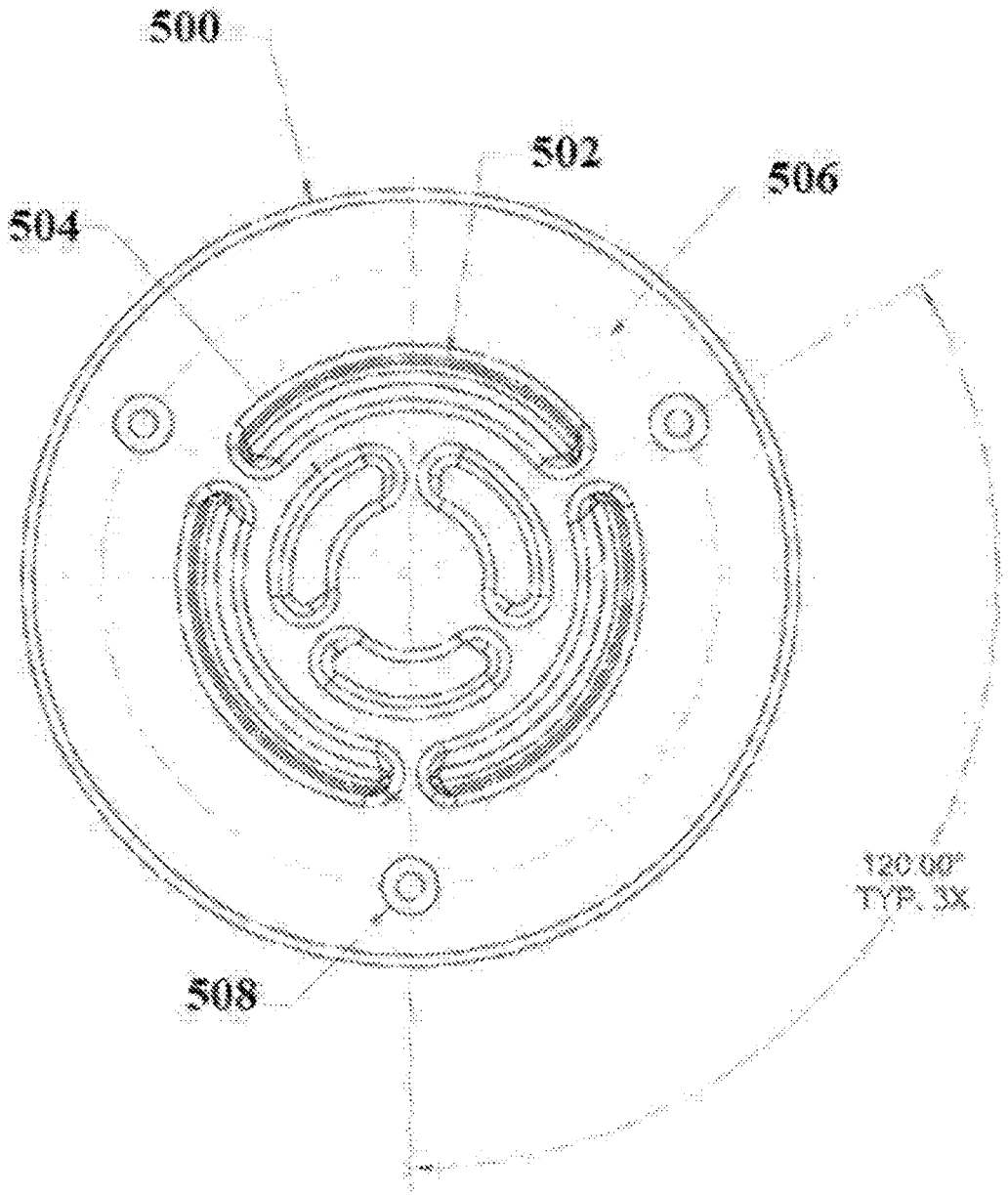
FIG. 10 is an isometric top view of the drain cover of FIG. 1, according to an exemplary embodiment.

FIG. 10 shows various dimensions of drain cover 102, according to an exemplary embodiment. In various embodiments, an outer diameter 500 of cover 102 is between 4 inches and 4.5 inches, specifically between 4.2 inches and 4.3 inches, and more specifically, is 4.25 inches with a tolerance of +0.00 and −0.03. An external opening drain diameter 502 of exterior openings $\mathbf{142}_b$ is between 2.25 inches and 2.75 inches, specifically between 2.3 inches and 2.5 inches, and more specifically, is 2.43 inches±0.10 inches. An internal drain diameter 504 of internal openings $\mathbf{142}_a$ is between 1.25 inches and 1.75 inches, specifically between 1.4 inches and 1.5 inches, and, more specifically, is 1.43 inches±0.10 inches. This orientation is designed to enhance ligation resistance by providing adequate spacing between exits $\mathbf{146}_a$ and $\mathbf{146}_b$ to prevent tying opposite ends of a rope through cover 102.

In some embodiments, three fastener locations 108 are spaced on a fastener diameter 506 between 3.25 and 3.5 inches, specifically 3.38±0.1 inches. As shown, fastener locations 108 are evenly spaced, e.g., at approximately 120°. Similarly, four fastener holes may be used and spaced at approximately 90°. In some embodiments, spacing and/or locations of fastener holes may follow customary drain fitting dimensions so that cover 102 can be retrofitted to an existing drain installation. In some embodiments, countersunk fastener locations 108 are used to prevent manipulation of screws 106 after installation. For example, a shank diameter of 0.10 to 0.20 inches can have a countersink between 80° and 90°. Specifically, a shank diameter 508 of 0.15±0.03 inches with a countersink of 82.00°±2.00° may have a countersink diameter 508 of between 0.25 inches and 0.35 inches, and, more specifically, 0.31±0.03 inches.

Figure 11:
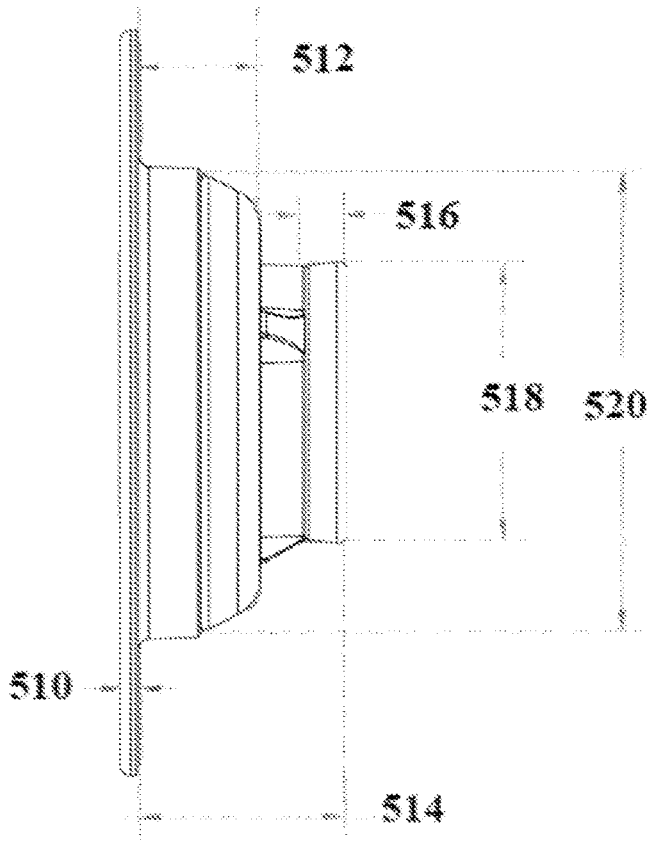
FIG. 11 is an isometric side view of the drain cover of FIG. 1, according to an exemplary embodiment.

FIG. 11 is an isometric side view of drain cover 102, according to an exemplary embodiment. A thickness 510 of top plate 136 is shown to be between 0.07 inches and 0.15 inches, specifically 0.11 inches. A length 512 from a bottom of plate 136 to exterior diverter wall 154 is between 0.5 inches and 1 inch, specifically between 0.60 inches and 0.80 inches, and more specifically, is 0.70 inches±0.05 inches. A length 514 from the bottom of plate 136 to interior diverter wall 152 is between 0.75 inches and 2 inches, specifically between 1 inch and 1.5 inches, and, more specifically, is 1.2±0.1 inches. For example, length 512 is 0.70±0.05 inches, and offset 156 is 0.5±0.05 inches for a total length 514 of 1.2±0.1 inches. Applicant has found that these dimensions enhance ligation resistance by increasing offset 156 while also not interfering with other dimensions of drain assembly 100.

FIG. 11 shows a curved deflector or interior diverter wall 152 with a wall thickness 516 of between 0.15 inches and 0.4 inches, specifically between 0.2 inches and 0.3 inches, and more specifically, 0.27 inches±0.03 inches. An outer diameter or width 518 of interior channels $\mathbf{144}_a$ is between 1.25 inches and 1.75 inches, specifically between 1.5 inches and 1.7 inches, and, more specifically, is 1.63±0.05 inches. Similarly, an outer diameter 520 of exterior channels $\mathbf{144}_b$ is between 2.5 inches and 3 inches, specifically between 2.6 inches and 2.8 inches, and more specifically, is 2.70 inches±0.05 inches. Lengths 512 and 514, as well as widths 518 and 520, enable placement of curvilinear channels $\mathbf{144}_a$ and $\mathbf{144}_b$ within cover 102. Similarly, diverter wall thickness 516 enables a curvilinear exit 146 from either channel 144.

Figure 12:
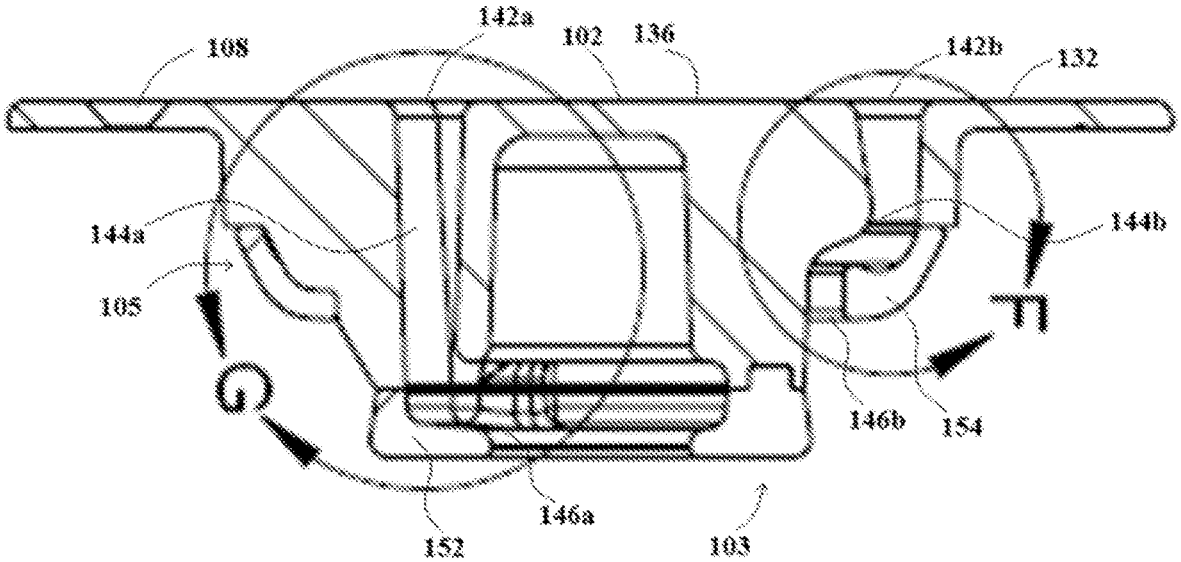
FIG. 12 is a cross-sectional side view of the drain cover of FIG. 1 taken along line 11-11 of FIG. 7, according to an exemplary embodiment.
Figure 13:
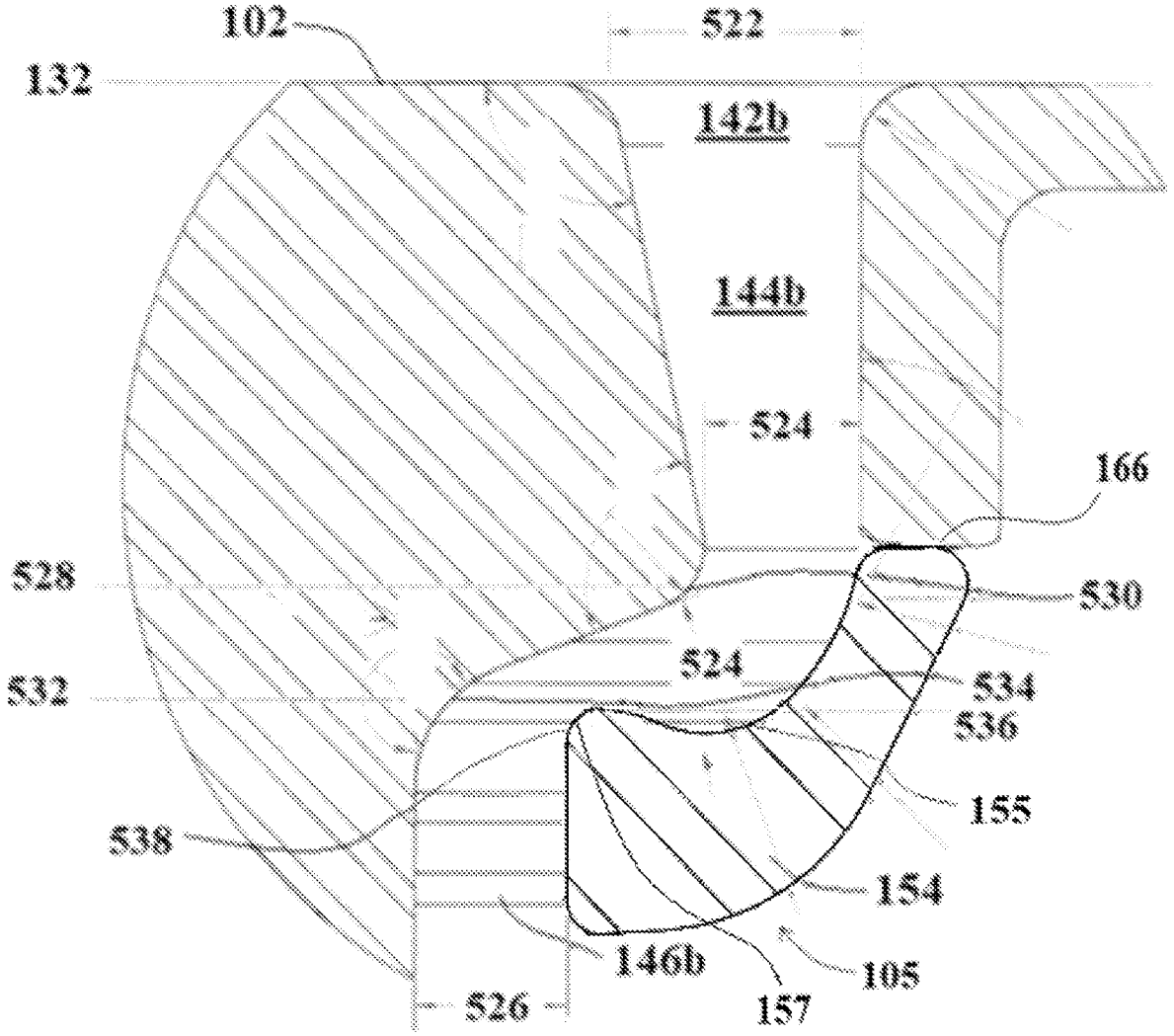
FIG. 13 is a detailed view of the cross-sectional area of circle F shown in FIG. 12, according to an exemplary embodiment.

FIG. 12 is a cross-sectional side view taken along line 11-11 of FIG. 5, according to an exemplary embodiment. FIG. 13 is a detailed view of a cross-sectional area of a drain cover according to an exemplary embodiment shown in the area of circle F shown in FIG. 12. FIG. 13 shows an exterior opening $\mathbf{142}_b$ with exterior channel $\mathbf{144}_b$ and exit $\mathbf{146}_b$. Exterior opening $\mathbf{142}_b$ has a width 522 of between 0.2 inches and 0.3 inches, specifically between 0.22 inches and 0.28 inches, and more specifically 0.25±0.1 inches. A channel width 524 defined by the minimum distance between opposing walls of channel $\mathbf{144}_b$ is between 0.1 inches and 0.2 inches, specifically between 0.12 inches and 0.18 inches, and more specifically 0.14±0.1 inches. A width 526 of exit $\mathbf{146}_b$ is shown to be between 0.1 inches and 0.2 inches, specifically between 0.12 inches and 0.18 inches, and more specifically 0.15±0.1 inches.

A depth 528 of a first bend 530, measured perpendicularly from top surface 132 towards exit 146, is between 0.40 inches and 0.60 inches, specifically between 0.45 inches and 0.55 inches, and more specifically is 0.50 inches±0.02 inches. Bends are any change in the direction of flow path 158 that is equal to greater than 60°. A depth 532 of a second bend 534 is between 0.60 inches and 0.65 inches, and specifically is 0.62 inches±0.01 inches. A depth 536 of a third bend 538 is between 0.60 inches and 0.75 inches, specifically between 0.68 inches and 0.72 inches, and more specifically, is 0.70 inches±0.01 inches. In some embodiments, exterior channel $\mathbf{144}_b$ has at least three bends (e.g., 530, 534, and 538) within a depth of 0.70±0.01 inches. Applicant has found that by increasing the number of bends, ligature prevention is enhanced by increasing resistance to a rope passing through channel 144, but without reducing the volume of water or other fluids that may pass through the channel 144 of drain assembly 100.

Figure 8:
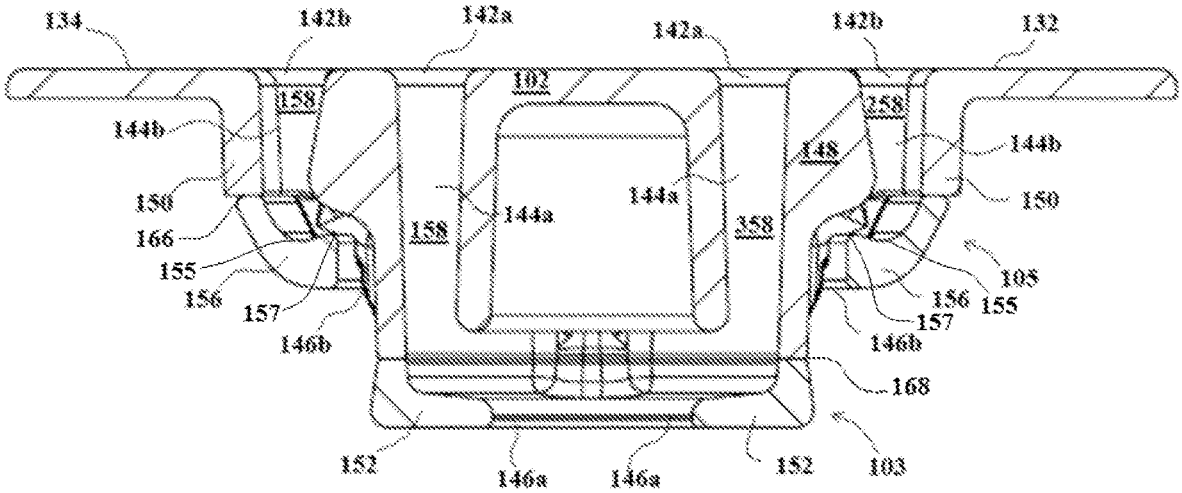
FIG. 8 is a side sectional view of the drain cover of FIG. 1 taken along line 10-10 of FIG. 5, according to an exemplary embodiment.
Figure 9:
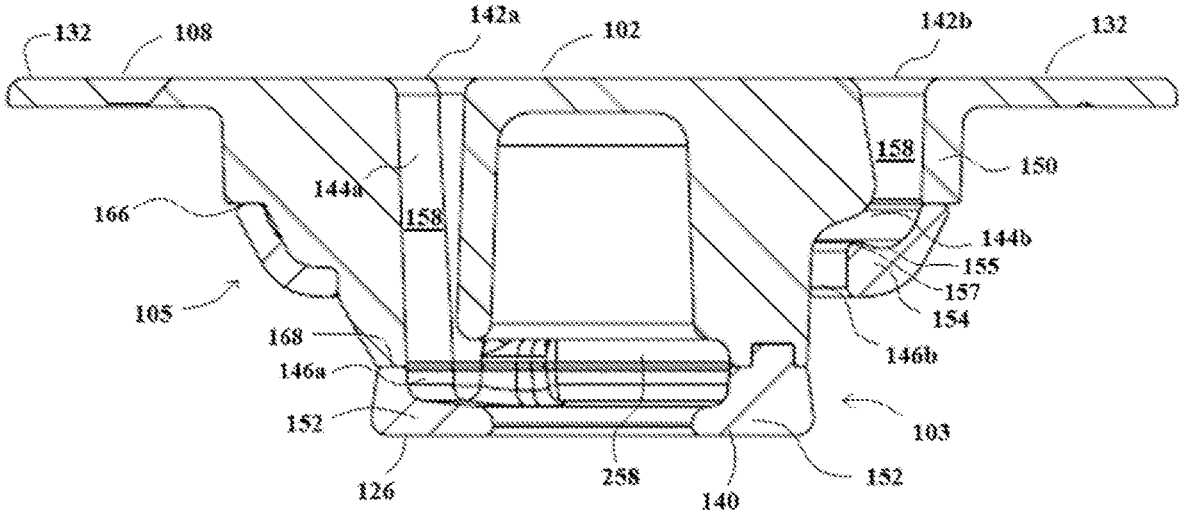
FIG. 9 is a side sectional view of the drain cover of FIG. 1 taken along line 11-11 of FIG. 5, according to an exemplary embodiment.

As shown in FIGS. 4, 8, and 13, exterior annular portion 105 includes a concave arcuate surface 155 and a protruding edge 157. In a specific embodiment, concave arcuate surface 155 and protruding edge 157 are located within exterior channels $\mathbf{144}_b$, $\mathbf{244}_b$, and $\mathbf{344}_b$. Protruding edge 157 is located at third bend 538 and extends away from bottom surface 140 of cover 102 and toward top surface 132. Concave arcuate surface 155 is located radially outward with respect to protruding edge 157 such that fluid flowing from exterior opening $\mathbf{142}_b$ toward exit $\mathbf{146}_b$ passes concave arcuate surface 155 before passing protruding edge 157. Concave arcuate surface 155 provides a recess in exterior annular portion 105 in a direction toward bottom surface 140 of cover 102 with respect to exterior channel $\mathbf{144}_b$.

Concave arcuate surface 155 provides a greater depth, measured perpendicularly from top surface 132, than depth 536. The greater depth of concave arcuate surface 155 with respect to protruding edge 157 results in a surface of exterior annular portion 105 within exterior channel $\mathbf{144}_b$ angling upward from concave arcuate surface 155 toward protruding edge 157. Concave arcuate surface 155 and protruding edge 157 cause a portion of the surface of exterior annular portion 105 that faces exterior channel $\mathbf{144}_b$ to curve upwards toward top surface 132 of cover 102. The configuration of concave arcuate surface 155 and protruding edge 157 results in channel width 524 being greater at concave arcuate surface 155 than at protruding edge 157. Applicant has found that by providing an upward angled surface and reduced channel width around a bend in channel 144, ligature prevention is increased by increasing resistance with respect to a rope or aglets of shoelaces passing through or wedging into channel 144 near bends 534 and 538.

Figure 14:
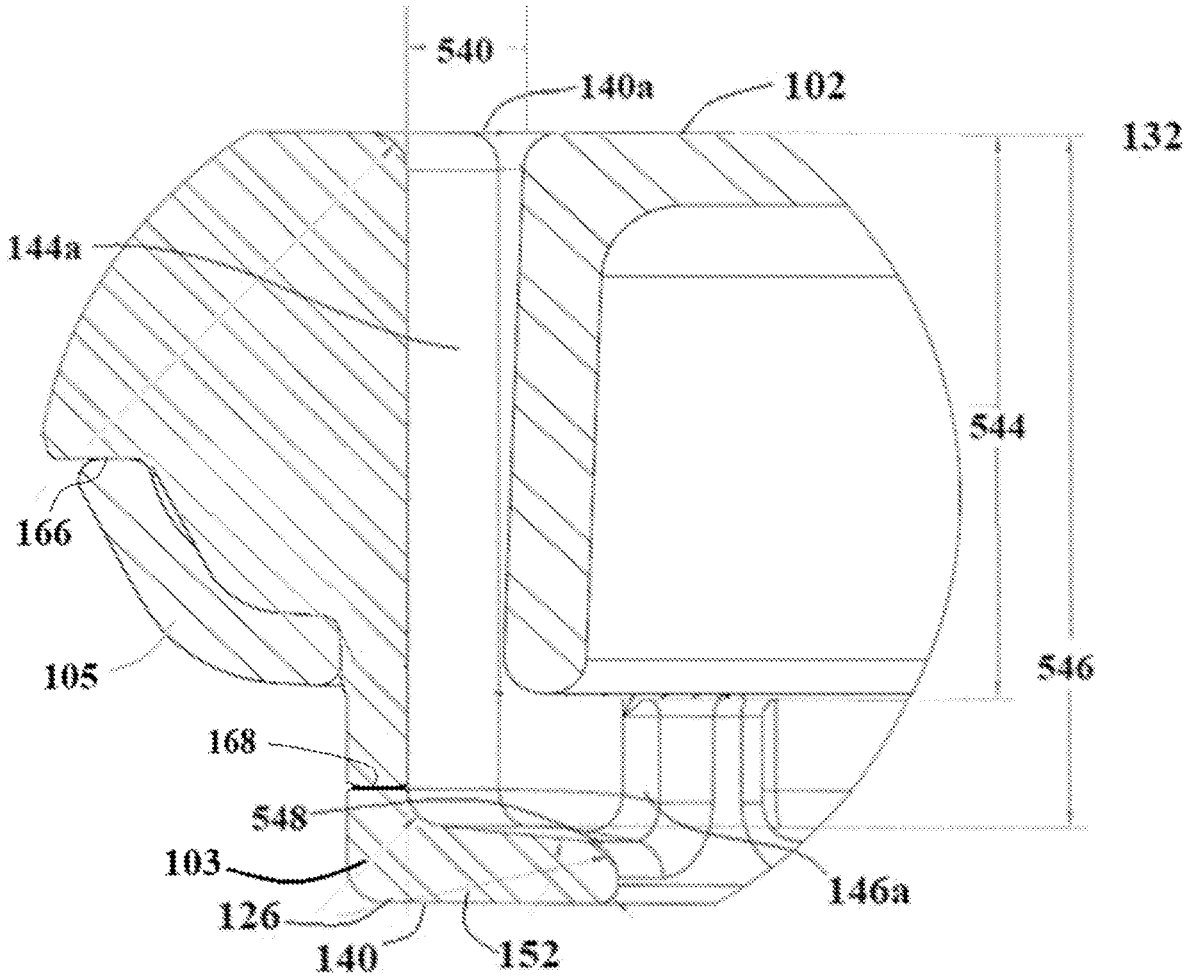
FIG. 14 is a detailed view of the cross-sectional area of circle G shown in FIG. 12, according to an exemplary embodiment.

FIG. 12 shows interior opening $\mathbf{142}_a$, interior channel $\mathbf{144}_a$, and interior exit $\mathbf{146}_a$. FIG. 14 is a detailed view of a cross-sectional area of a drain cover according to an exemplary embodiment shown in the area of circle G shown in FIG. 12. Similar to FIG. 12, FIG. 14 shows interior opening $\mathbf{142}_a$ with interior channel $\mathbf{144}_a$ and exit $\mathbf{146}_a$. In various embodiments, a width 540 of opening $\mathbf{142}_a$ is equal to a width 540 of interior channel $\mathbf{144}_a$ and/or exit $\mathbf{146}_a$. Width 540 is between 0.10 inches and 0.30 inches, and specifically is between 0.14 inches and 0.26 inches, and more specifically is 0.25±0.1 inches. Interior channel $\mathbf{144}_a$ has a first bend 542 at a first depth 544 between 0.80 and 1.10 inches, specifically between 0.90 and 1.00 inches, and specifically, 0.96±0.2 inches. A second bend 546 is located at a second depth 548 between 1.10 inches and 1.20 inches, specifically between 1.15 inches and 1.18 inches, and more specifically, is 1.17±0.2 inches.

Figure 15:
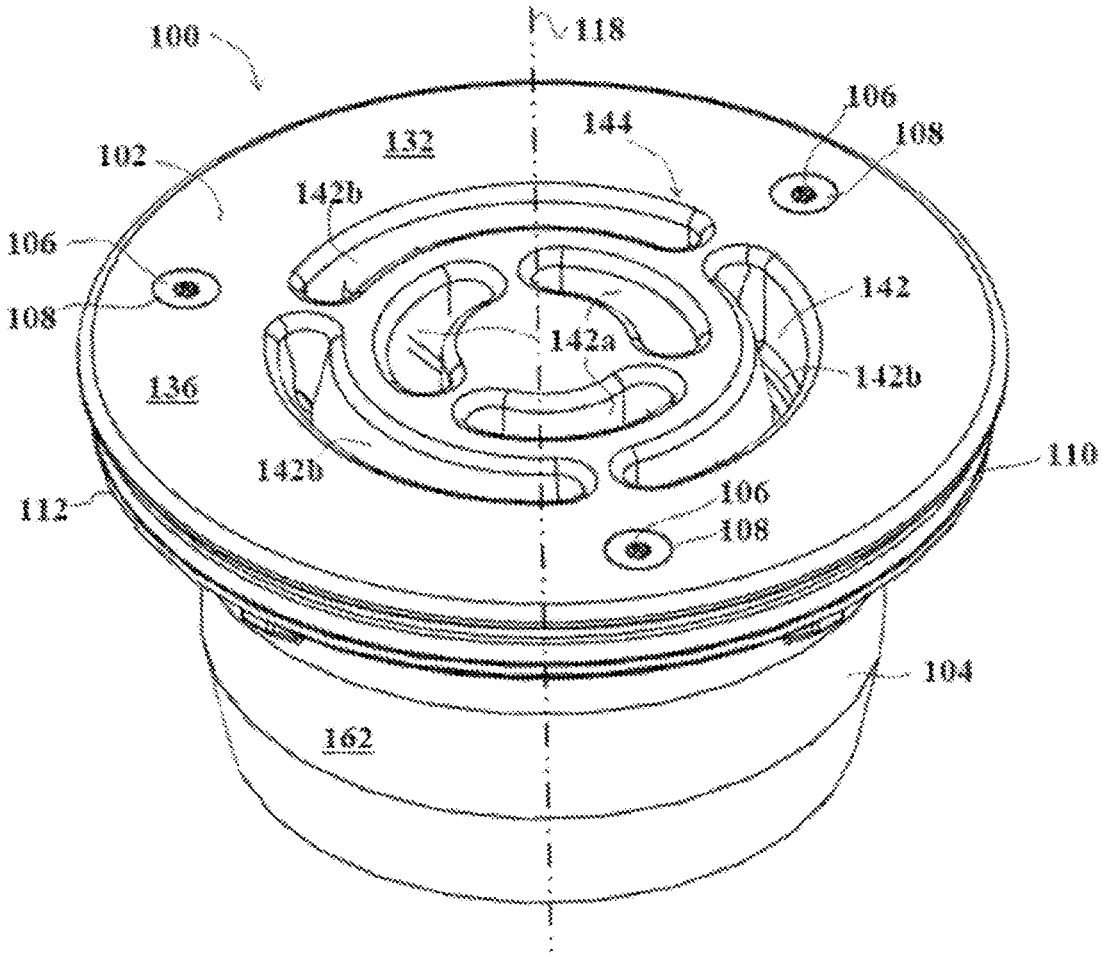
FIG. 15 is a perspective view of a ligation resistant drain assembly including the drain cover of FIG. 1, according to an exemplary embodiment.

FIG. 15 illustrates a perspective view of a multi-channel ligation resistant drain assembly 100, according to an exemplary embodiment. Drain assembly 100 includes drain cover 102 coupled to a drain body 104 with one or more tamper-resistant flat head screws 106 through fastener holes or locations 108 of cover 102 and anchoring into threaded nuts or inserts 109 in drain body flange 130. In one embodiment, screws 106 include a head configured with six or more points in a star-shaped pattern enhance tamper resistance. A washer-shaped rubber seal or washer 110 and/or a fiber washer 112 to couple the drain body 104 to an underside of the floor. Drain body 104 forms a bridge to existing piping (e.g., interchangeably forms a fluid-tight seal with PVC, steel, copper, or other plumbing). A rubber sleeve 114 bridges drain body 104 over the joint to seal the connection.

Similarly, a clamping ring or compression nut 116 outside drain body 104 fastens drain body 104 to the floor. In some embodiments, drain assembly 100 is circular and defined radially from a central axis 118.

Figure 16:
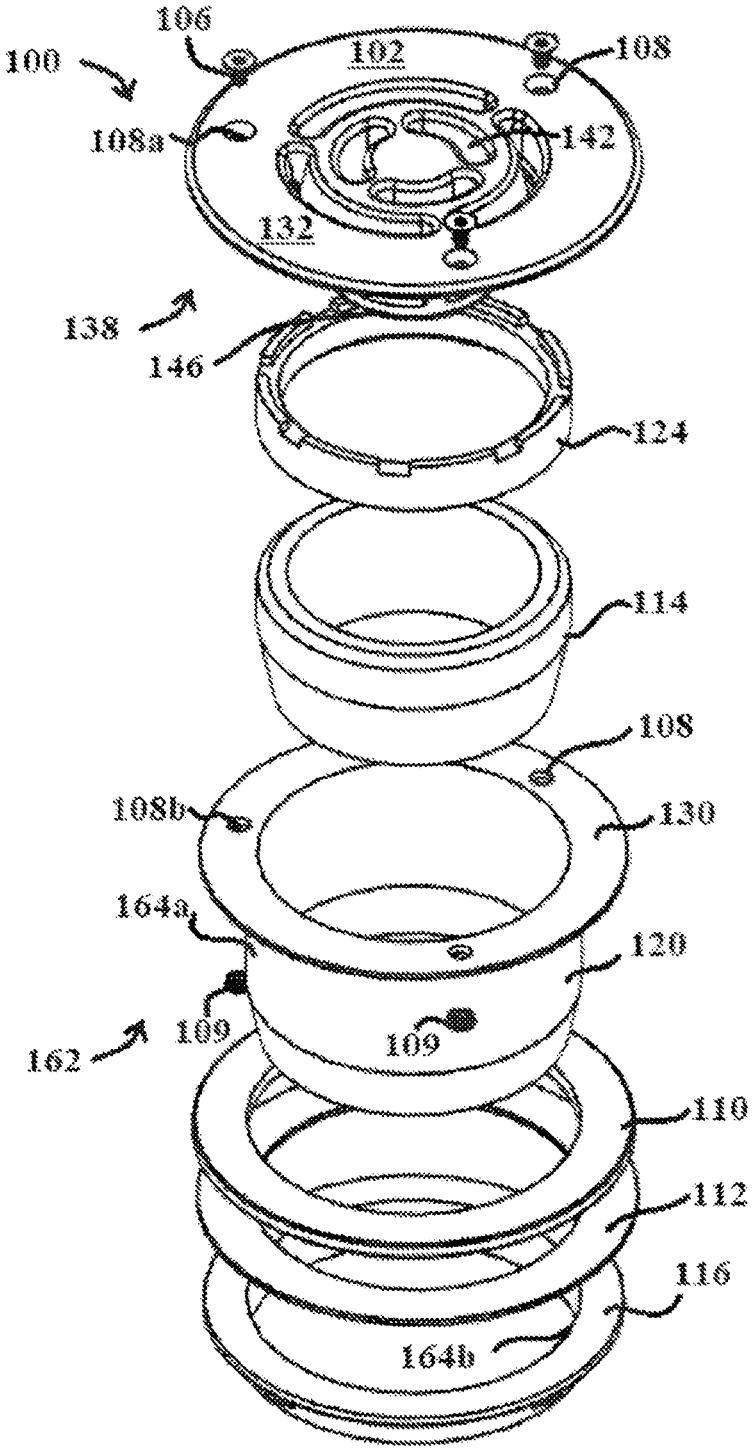
FIG. 16 is an exploded perspective view of the drain assembly of FIG. 15, according to an exemplary embodiment.

FIG. 16 shows an exploded perspective view of the drain assembly 100 of FIG. 1. Cover 102 couples to drain body 104 via screws 106. Rubber washer 110 extends around tubular portion 120 and is captured between the floor and fiber washer 112. Fiber washer 112 is captured between rubber washer 110 and compression nut 116. Compression nut 116 secures the drain body 104 to the floor. Internal compression ring 124 presses downward on rubber sleeve 114 to seal the joint between drain assembly 100 and the existing drainpipe. Internal compression ring 124 and rubber sleeve 114 cooperate to capture and/or secure the pipe within drain assembly 100.

Figure 17:
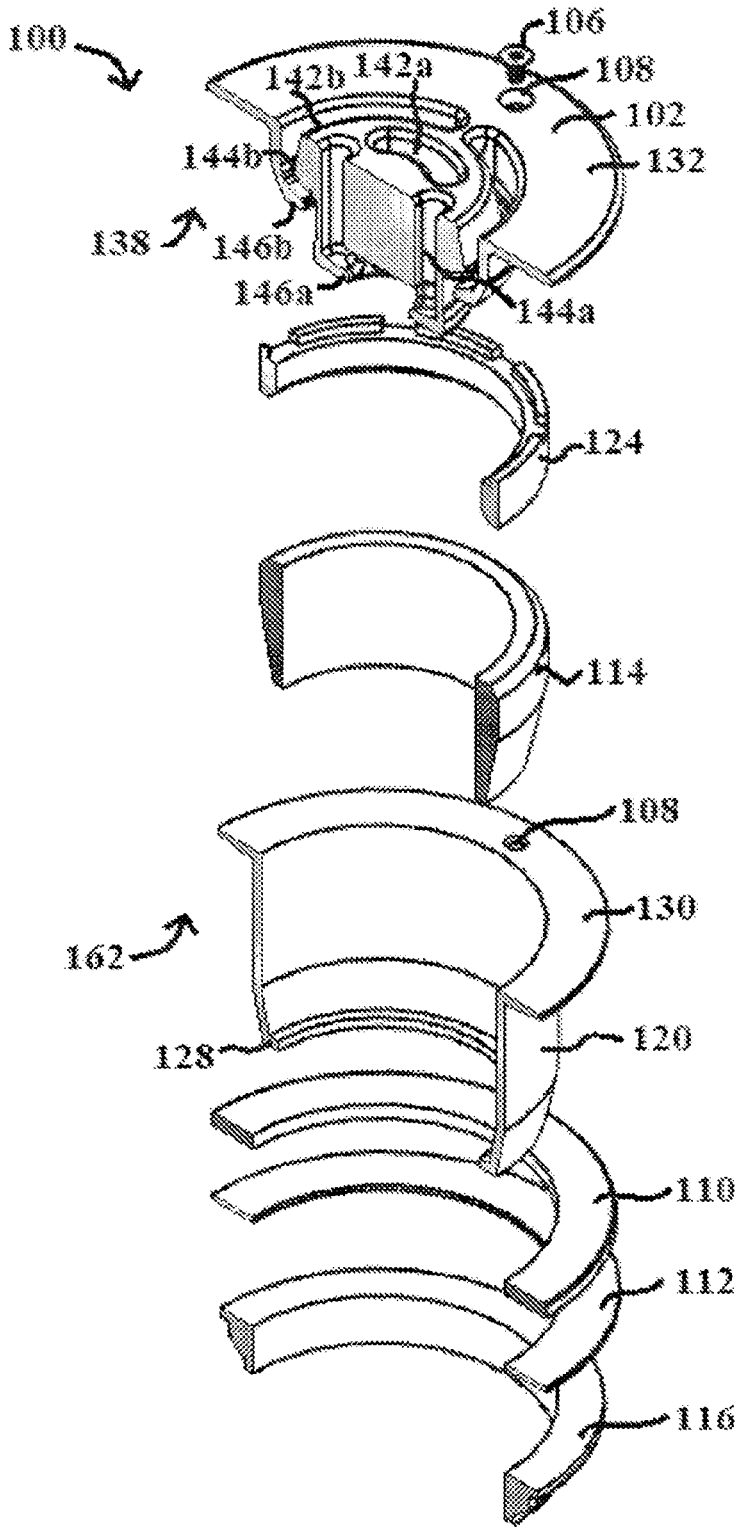
FIG. 17 is an exploded, perspective, sectional view of the assembly of FIG. 15, according to an exemplary embodiment.

FIG. 17 is a cross-sectional view and better illustrates the cooperation of internal compression ring 124 and rubber sleeve 114 to seal drain body 104 to existing pipe installation. Rubber sleeve 114 fits under internal compression ring 124 to bridge the joint between drain body 104 and the existing pipe. Bottom of drain body 104 may include a lip 128 that cooperates or couples to rubber sleeve 114 to retain sleeve 114 within drain body 104. Similarly, an upper flange 130 of drain body 104 may be configured to couple to cover 102.

Drain assembly 100 and/or cover 102 can be configured as a new installation or as an improvement on an existing installation. Drain assembly 100 for a new or an existing installation may use the same components described above or may incorporate some or all of the differences described below.

In some embodiments, drain assembly 100 has an interface 162 (FIGS. 15 and 16) that creates a sealed fluid channel 144 between a flow source and a drain pipe to replace an existing drain (e.g., a channel 144 from top surface 132 to bottom surface 140 of cover 102). Interface 162 is made from a suitable plumbing material, such as PVC, brass, and/or copper. The drain cover 102 interface 162 has flange 130 configured for attachment to a surface of a floor. Flange 130 couples to the surface (e.g., directly to the floor) to join a tubular portion 120 to the existing drain pipe. In some embodiments, drain cover 102 has fastener locations 108 to fit a conventional drain. For example, with reference to FIG. 16, tamper resistant screws 106 and/or tamper resistant nuts or inserts 109 are disposed at fastener locations $\mathbf{108}_a$ on drain cover 102 and through fastener locations $\mathbf{108}_b$ on flange 130 to couple with inserts 109 and secure a new or pre-existing drain installation.

In some embodiments, a plurality of tamper-resistant flat head screws 106 are inserted at a plurality of counter-sunk fastener hole locations 108 of cover 102. Screws 106 are anchored at a plurality of threaded inserts 109 in a drain body 104 flange 130. Tamper-resistant flat head screws 106 may be chamfered as shown to fit in the counter-sunk locations 108 and anchor in threaded inserts 109 of flange 130. Inserts 109 can be new (e.g., with a new drain installation) or pre-installed (e.g., with a pre-existing installation). For example, cover 102 includes fastener locations 108 that are retrofit for an existing drain body 104 installation. Specifically, the illustrated embodiment shows at least three screws 106 inserted into at least three locations 108 on cover 102. Screws 106 anchor in three inserts 109 on drain body 104 and/or flange 130.

Drain assembly 100 may include a threaded clamping ring, the same as or similar to internal compression ring 124. In contrast to the internal compression ring 124 described above, threaded compression or compression nut 116 couples with exterior tubular portion 120 that includes external threads $\mathbf{164}_a$ configured to be engaged with internal threads $\mathbf{164}_b$ of compression nut 116 and fasten drain assembly 100 to a floor. In this configuration, tubular portion 120 of drain assembly 100 couples to the existing installation by capturing a portion of the floor between flange 130 and threaded compression nut 116.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes, and omissions may also be made in the design, operating conditions and arrangement of the various exemplary embodiments without departing from the scope of the present invention.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths, and radii, as shown in the Figures, are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. In various embodiments, the present disclosure extends to a variety of ranges (e.g., plus or minus 30%, 20%, or 10%) around any of the absolute or relative dimensions disclosed herein or determinable from the Figures.

What is claimed is:

1. A multi-channel, ligation resistant drain cover having a top side and a bottom side, the cover comprising:

a top plate including a top surface, a bottom surface, a periphery, a first interior fluid flow opening extending between the top surface and the bottom surface, and a first exterior fluid flow opening extending between the top surface and the bottom surface and located between the interior fluid flow opening and the periphery;

an exterior fluid guide wall extending from the bottom surface between the periphery and the exterior fluid flow opening;

an intermediate fluid guide wall extending from the bottom surface between the interior and exterior flow openings, the exterior and intermediate fluid guide walls being located to form a curved exterior fluid flow channel extending from the top surface, through the exterior fluid flow opening and exiting at the bottom side of the cover at an exterior exit;

an interior fluid guide wall extending from the bottom surface and cooperating with the intermediate fluid guide wall to form a curved interior fluid flow channel separate from the exterior fluid flow channel and extending from the top surface, through the interior fluid flow opening and exiting at the bottom side of the cover at an interior exit separate from and displaced from the exterior exit;

a first diverter wall extending at a first angle from the exterior fluid guide wall, the first diverter wall displaced from the bottom surface of the top plate such that the exterior fluid guide wall is positioned between the first diverter wall and the bottom surface;

a second diverter wall extending at a second angle from the intermediate fluid guide wall, the second diverter wall displaced from the bottom surface of the top plate such that the intermediate fluid guide wall is positioned between the second diverter wall and the bottom surface; and a first bonding material and a second bonding material;

wherein the first diverter wall is a separate component from the top plate and the exterior fluid guide wall, the first diverter wall being coupled to the exterior fluid guide wall by the first bonding material;

wherein the second diverter wall is a separate component from the top plate and the intermediate fluid guide wall, the second diverter wall being coupled to the intermediate fluid guide wall by the second bonding material; and wherein the first diverter wall includes a protruding edge, the protruding edge extending into the curved exterior fluid flow channel and away from the bottom side of the cover such that a surface of the exterior fluid guide wall that forms the curved exterior fluid flow channel curves toward the top surface of the cover.

2. The cover of claim 1, wherein the interior exit is located further from the bottom surface than the exterior exit.

3. The cover of claim 2, wherein the first diverter wall includes a first wall parallel with the top plate; and wherein the second diverter wall includes a second wall parallel with the top plate and displaced from the first diverter wall.

4. The cover of claim 3, including at least a second interior flow opening, and two interior dividing walls extending between the intermediate fluid guide wall and the interior fluid guide wall to form two separate interior flow paths through the interior fluid flow channel associated with each of the interior flow openings.

5. The cover of claim 4, including at least a second exterior flow opening, and two exterior dividing walls extending between the intermediate fluid guide wall and the exterior fluid guide wall to form two separate exterior flow paths through the exterior fluid flow channel associated with each of the exterior flow openings.

6. The cover of claim 3, including at least second and third interior flow openings, and three interior dividing walls extending between the intermediate fluid guide wall and the interior fluid guide wall to form three separate interior flow paths through the interior fluid flow channel associated with each of the interior flow openings.

7. The cover of claim 4, including at least second and third exterior flow openings, and three exterior dividing walls extending between the intermediate fluid guide wall and the exterior fluid guide wall to form three separate exterior flow paths through the exterior fluid flow channel associated with each of the exterior flow openings.

8. The cover of claim 1, wherein the first bonding material and the second bonding material are welded metals.

9. The cover of claim 8, wherein the top plate includes a first metal, the first diverter wall includes a second metal, and the second diverter wall includes a third metal; and wherein the first bonding material includes the first metal and the second metal, and the second bonding material includes the first metal and the third metal.

10. The cover of claim 1, wherein the first bonding material and the second bonding material are adhesives.

11. A multi-channel, ligation resistant drain assembly comprising;

an interface for creating a sealed fluid channel between a flow and a drainpipe, the interface including a flange for attachment to a floor surface, the flange being joined to a tubular portion for attachment to the drainpipe; and a drain cover including:

a top plate formed from a first metal, the top plate being attachable to the flange and including a top surface, a bottom surface, a periphery, a first interior fluid flow opening extending between the top and bottom surface, and a first exterior fluid flow opening extending between the top and bottom surface and located between the interior fluid flow opening and the periphery;

an exterior fluid guide wall extending from the bottom surface between the periphery and the exterior fluid flow opening;

a first diverter wall formed from a second metal and extending at a first angle from the exterior fluid guide wall, the first diverter wall displaced from the bottom surface of the top plate such that the exterior fluid guide wall is positioned between the first diverter wall and the bottom surface;

an intermediate fluid guide wall extending from the bottom surface between the interior and exterior flow openings, the exterior and intermediate fluid guide walls being located to form a curved exterior fluid flow channel extending from the top surface, through the exterior fluid flow opening and exiting at the periphery of the cover at an exterior exit;

a second diverter wall formed from a third metal and extending at a second angle from the intermediate fluid guide wall, the second diverter wall displaced from the bottom surface of the top plate such that the intermediate fluid guide wall is positioned between the second diverter wall and the bottom surface;

an interior fluid guide wall extending from the bottom surface and cooperating with the intermediate fluid guide wall to form a curved interior fluid flow channel separate from the exterior fluid flow channel and extending from the top surface, through the interior fluid flow opening and exiting at the periphery of the cover at an interior exit separate from and displaced from the exterior exit; and a first bonding material and a second bonding material;

wherein the first diverter wall is a separate component from the top plate that is coupled to the first bonding material, the first diverter wall being coupled to the top plate by a first welded joint, the first welded joint including the first metal and the second metal; and wherein the second diverter wall is a separate component from the top plate that is coupled to the second bonding material, the second diverter wall being coupled to the top plate by a second welded joint, the second welded joint including the first metal and the third metal.

12. The assembly of claim 11, further comprising a plurality of tamper-resistant flat head screws that are inserted at a plurality of counter-sunk fastener holes of the cover and anchored in a plurality of threaded inserts in a drain body flange.

13. The assembly of claim 12, wherein the tamper-resistant flat head screws are anchored in pre-installed threaded inserts in the drain body flange, wherein the cover has fastener locations that are retrofit for an existing drain body.

14. The assembly of claim 12, further comprising at least three tamper-resistant flat head screws inserted into at least three counter-sunk fastener holes on the cover and anchored in three threaded inserts of the drain body flange.

15. The assembly of claim 11, including at least second and third interior flow openings, and three interior dividing walls extending between the intermediate fluid guide wall and the interior fluid guide wall to form three separate interior flow paths through the interior fluid flow channel associated with each of the interior flow openings.

16. The assembly of claim 15, including at least second and third exterior flow openings, and three exterior dividing walls extending between the intermediate fluid guide wall and the exterior fluid guide wall to form three separate exterior flow paths through the exterior fluid flow channel associated with each of the exterior flow openings.

17. The assembly of claim 16, wherein the top plate, the first diverter wall, and the second diverter wall are circular, and the exterior and intermediate guide walls each include respective cylindrical portions; and wherein the cover is formed from cast stainless steel, and the interface is formed from brass.

18. The assembly of claim 11, wherein the first diverter wall includes a protruding edge, the protruding edge extending into the curved exterior fluid flow channel and away from a bottom side of the cover such that a surface of the exterior fluid guide wall that forms the curved exterior fluid flow channel curves toward the top surface of the top plate.

19. A method for manufacturing a multi-channel, ligation resistant drain cover having a top side and a bottom side, the method comprising:

forming a drain cover body from a first material, the drain cover body including a top plate, an exterior fluid guide wall, an intermediate fluid guide wall, and an interior guide wall;

forming an exterior annular portion from a second material, the exterior annular portion including a first diverter wall such that the exterior annular portion is a separate component from the drain cover body;

forming an interior annular portion from a third material, the interior annular portion including a second diverter wall such that the interior annular portion is a separate component from the drain cover body;

coupling the exterior annular portion to the drain cover body by a first bonding material; and coupling the interior annular portion to the drain cover body by a second bonding material;

wherein the manufactured drain cover comprises:

the top plate including a top surface, a bottom surface, a periphery, a first interior fluid flow opening extending between the top and bottom surface, and a first exterior fluid flow opening extending between the top and bottom surface and located between the interior fluid flow opening and the periphery;

the exterior annular portion including the first diverter wall;

the exterior fluid guide wall extending from the bottom surface between the periphery and the exterior fluid flow opening, wherein the first diverter wall of the exterior annular portion is coupled to the exterior fluid guide wall and is displaced from the bottom surface of the top plate such that the exterior fluid guide wall is positioned between the bottom surface and the first diverter wall, wherein the first diverter wall extends at a first angle from the exterior fluid guide wall;

the interior annular portion including the second diverter wall;

the intermediate fluid guide wall extending from the bottom surface between the interior and exterior flow openings, wherein the second diverter wall of the interior annular portion is coupled to the intermediate fluid guide wall and is displaced from the bottom surface of the top plate such that the intermediate fluid guide wall is positioned between the bottom surface and the second diverter wall, wherein the second diverter wall extends at a second angle from the intermediate fluid guide wall, the exterior and intermediate fluid guide walls being located to form a curved exterior fluid flow channel extending from the top surface, through the exterior fluid flow opening and exiting at the bottom side of the cover at an exterior exit;

an interior fluid guide wall extending from the bottom surface and cooperating with the intermediate fluid guide wall to form a curved interior fluid flow channel separate from the exterior fluid flow channel and extending from the top surface, through the interior fluid flow opening and exiting at the bottom side of the cover at an interior exit separate from and displaced from the exterior exit; and the first bonding material and the second bonding material.

20. The method of claim 19, wherein the first bonding material and the second bonding material are welded metals, the first bonding material including the first material and the second material, and the second bonding material including the first material and the third material.

* * * * *